US009697926B2

(12) United States Patent
Huang et al.

(10) Patent No.: US 9,697,926 B2
(45) Date of Patent: Jul. 4, 2017

(54) FLAT CABLE

(71) Applicant: FOXCONN INTERCONNECT TECHNOLOGY LIMITED, Grand Cayman, KY (US)

(72) Inventors: Shuai-Hui Huang, Kunshan (CN); Ru-Yang Guo, Kunshan (CN); Qing-Man Zhu, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/081,964

(22) Filed: Mar. 28, 2016

(65) Prior Publication Data

US 2016/0284438 A1 Sep. 29, 2016

(30) Foreign Application Priority Data

Mar. 27, 2015 (CN) ..... 2015 2 0177824

(51) Int. Cl.
*H01B 7/08* (2006.01)
*H01B 11/20* (2006.01)

(52) U.S. Cl.
CPC ..... *H01B 7/0823* (2013.01); *H01B 11/203* (2013.01)

(58) Field of Classification Search
CPC ..... H01B 7/08; H01B 11/06; H01B 11/10; H01B 11/04
USPC ..... 174/114 R, 117 F
See application file for complete search history.

(56) References Cited

U.S. PATENT DOCUMENTS 4,096,346 A * 6/1978 Stine ..... B29C 47/128 174/110 AR
5,084,594 A * 1/1992 Cady ..... H01B 7/083 174/117 F
6,444,902 B1 * 9/2002 Tsao ..... H01B 7/0861 174/113 R
6,630,624 B2 * 10/2003 Tsao ..... H01B 11/1091 174/113 R
6,765,150 B2 7/2004 Hsieh
6,969,807 B1 * 11/2005 Lin ..... H01B 7/0861 174/117 F
2009/0166082 A1 * 7/2009 Liu ..... H01B 7/0823 174/359
2012/0111602 A1 * 5/2012 Wei ..... H01B 7/0861 174/114 R
2013/0240243 A1 * 9/2013 Gundel ..... H01B 7/0838 174/117 F

* cited by examiner

*Primary Examiner* — Timothy Thompson
*Assistant Examiner* — Michael F McAllister
(74) *Attorney, Agent, or Firm* — Wei Te Chung; Ming Chieh Chang

(57) ABSTRACT

A flat cable includes a number of pairs of differential signal wires and a number of power wires distributed on two sides of the differential signal wires. The differential wires are horizontally and vertically arranged in a matrix.

19 Claims, 2 Drawing Sheets

FLAT CABLE

BACKGROUND OF THE INVENTION

1. Field of the Invention

The present invention relates to a flat cable, especially to a flat cable for transmitting a display signal and a power signal at the same time.

2. Description of Related Arts

A flat cable is thin and compact in size. As opposed to a flat cable, if a display wire, a power wire, and a USB wire were put in together, a diameter of the cable will increase. In addition to occupying a large space and having a large diameter, round and multi core cable has other shortcomings, e.g., pre-machining difficulties and complex post-processing steps.

U.S. Pat. No. 6,765,150, issued on Jul. 20, 2004, discloses a flat cable. The flat cable includes a pair of signal lines and two power lines distributed on two sides of the signal lines in a horizontal direction. This cable has one pair of signal lines but no detect lines.

A flat cable for transmitting a display signal, a power signal, and a USB signal simultaneously is desired.

SUMMARY OF THE INVENTION

An object of the present invention is to provide a flat cable having a compact structure.

To achieve the above-mentioned object, a flat cable comprises a plurality of pairs of differential signal wires, and a plurality of power wires distributed on two sides of the differential signal wires. The differential signal wires are horizontally and vertically arranged in a matrix.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
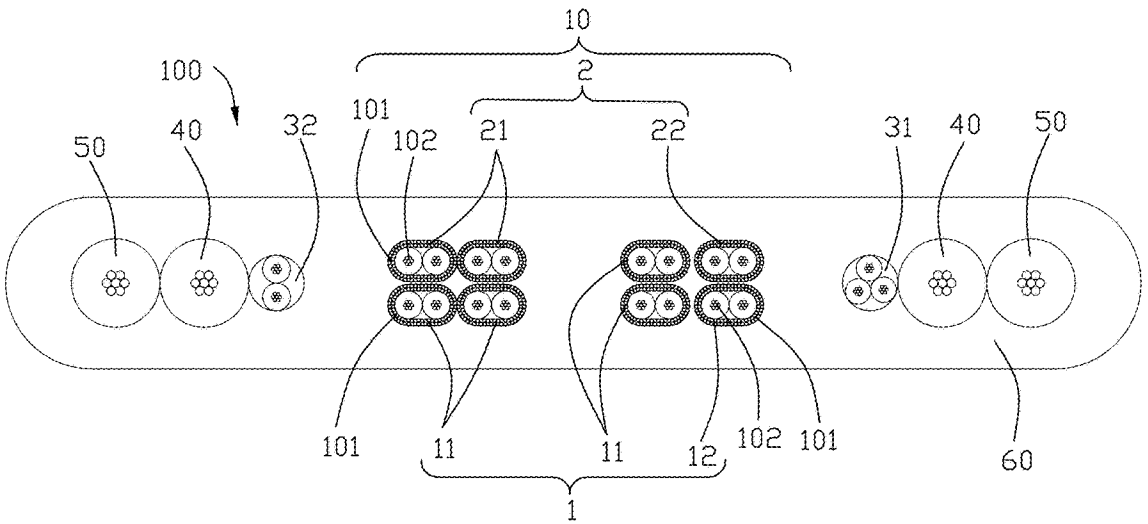
FIG. 1 is a cross-sectional view of the flat cable according to the present invention.
Figure 2:
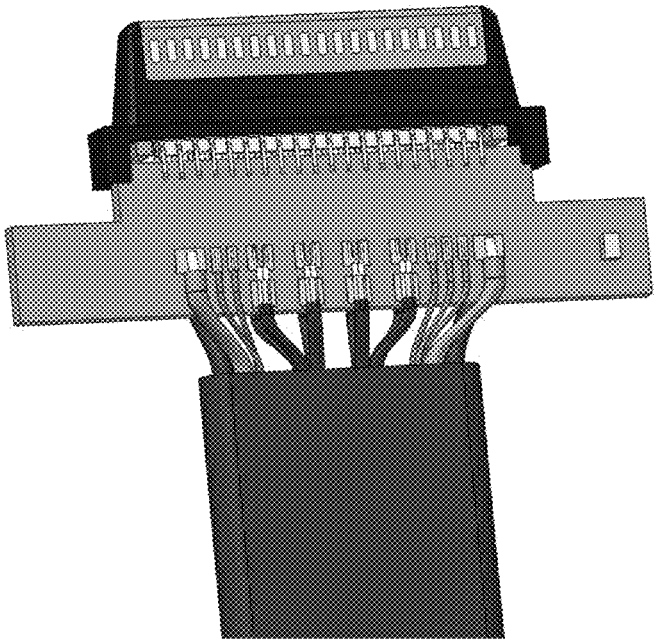
FIG. 2 is a perspective view of the connector assembly with an internal printed circuit board linked between the flat cable of FIG. 1 and the front connection unit.

Referring to FIGS. 1 and 2, a plat cable 100 consists of a number of wires having different thicknesses. Each wire has a core and an insulative layer enclosed the core. The plat cable 100 includes a plurality of differential signal wires 10, two power wires 40 distributed in two sides of the differential signal wires 10 in a horizontal direction for transmitting the power, and two ground wires 50 distributed in out side of the power wires 40. The differential wires 10 horizontally and vertically arranged in a matrix. The plate cable 100 further includes a number of detect wires 31, 32 between the power wire 40 and the differential signal wires 10 and an insulative boot 60 enclosed the differential signal wires 10, power wires 40, ground wires 50 and the detect wires 31, 32. In this embodiment, the plat cable 100 has a center line in a vertical direction. The power wires 40 and the ground wires 50 are symmetrically distributed along the center line in two sides of the differential signal wires 10. The plat cable 100 connects with a display equipment. The detect wires 31, 32 transmit the hot-plug detect signal feedback from the display equipment. The detect wire 31 consists of three core, the detect wire 32 consists of two core. The amount of the core is set according to the customer's demand. The detect wire 31 and the detect wire 32 are symmetrically distributed along the center line.

The differential signal wires 10 includes a first wire group 1 for transmitting a DP (DisplayPort) signal and a second wire group 2 for transmitting a USB (Universal Serial Bus) signal. The first wire group 1 includes four first wires 11 for transmitting a first display signal and a second wire 12 for transmitting a second display signal. The second wire 12 is an auxiliary channel. The second display signal can be a signal of a touch screen. The second wire group 2 includes two third wires 21 for transmitting a USB 2.0 signal and a forth wires 22 for transmitting a USB 3.0 signal. Each of the first wire 11, second wire 12, third wire 21, and forth wire has a pair of differential cores 102 and a metal mesh ground layer 101 enclosed the differential core 102. Each pair of the differential cores 102 is arranged along a width direction of the plat cable 100. So the thickness of the insulative boot 60 can be made no more than 2.5 mm Notably, in this arrangement, as shown in FIG. 2 on one hand the differently leveled differential wires 10 are respectively soldered upon the different/opposite surfaces of the internal printed circuit board easily, and on the other hand, the neighboring ground wire 50 and power wire 40 are also soldered on two opposite surfaces for not affecting each other.

The plat cable 100 has a compact structure and can transmit multiple signals. The wires orderly arrange, that convenient for later laser cutting processing and automated production.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A flat cable comprises:

a plurality of pairs of differential signal wires;

a plurality of power wires distributed on two sides of the differential signal wires; and the differential signal wires horizontally and vertically arranged in a matrix.

2. The flat cable as claimed in claim 1, further comprising two ground wires distributed on a side of the power wires in a horizontal direction.

3. The flat cable as claimed in claim 2, further comprising two detect wires.

4. The flat cable as claimed in claim 3, wherein the detect wire is disposed between the power wire and the differential signal wires.

5. The flat cable as claimed in claim 1, wherein the power wires are symmetrically distributed along a center line in a vertical direction.

6. The flat cable as claimed in claim 1, wherein the differential signal wires comprise a first wire group for transmitting a display signal and a second wire group for transmitting a USB signal.

7. The flat cable as claimed in claim 6, wherein the first wire group comprises a first wire for transmitting a first display signal and a second wire for transmitting a second display signal.

8. The flat cable as claimed in claim 6, wherein the second wire group comprises a third wire for transmitting a USB 2.0 signal and a forth wire for transmitting a USB 3.0 signal.

9. A flat cable assembly comprising:

plural pairs of differential pair wires and power wires and ground wires side by side arranged with one another in a transverse direction and enclosed within an insulative jacket;

said power wires being symmetrically located by two sides of said plural pairs of differential pair wires;

said ground wires being symmetrically located by two sides of said power wires and said plural pairs of differential pair wires; wherein each pair of said differential pair wires are internally side by side intimately arranged with each other in the transverse direction, and all said differential pair wires are symmetrically arranged in two levels for respectively soldering to two opposite surfaces of an internal printed circuit board in an electrical connector.

10. The flat cable assembly as claimed in claim 9, wherein there are four pairs of the differential pair wires for a same protocol signal transmission, and two pairs of said four pairs are intimately arranged side by side in said transverse direction while the remaining two pairs of said four pairs are intimately stacked with each other in the vertical direction at two levels.

11. The flat cable assembly as claimed in claim 10, wherein the two pairs side by side arranged with each other, are located at a same level with one of said two levels.

12. The flat cable assembly as claimed in claim 10, wherein the two pairs side by side arranged with each other, are spaced from the remaining two pairs with a distance in the transverse direction.

13. The flat cable assembly as claimed in claim 12, wherein said distance is not less than a transverse dimension of each pair of said differential pair wires.

14. The flat cable assembly as claimed in claim 9, wherein there are three pairs of the differential pair wires for another protocol signal transmission, and one pair of said three pairs and two pairs of said three pairs are separated from each other by the remaining two pairs of said four pairs in said transverse direction.

15. The flat cable assembly as claimed in claim 9, wherein the ground wires are respectively soldered upon said two opposite surfaces of the printed circuit board.

16. The flat cable assembly as claimed in claim 15 wherein said power wires are respectively soldered upon said two opposite surfaces of the printed circuit board.

17. The flat cable assembly as claimed in claim 9, further including detect wires located between the differential pair wires and the corresponding power wire in the transverse direction.

18. A flat cable assembly comprising:

plural pairs of differential pair wires and power wires and ground wires side by side arranged with one another in a transverse direction and enclosed within an insulative jacket;

each pair of said differential pair wires are internally side by side intimately arranged with each other in the transverse direction, and all said differential pair wires are symmetrically arranged in two levels for respectively soldering to two opposite surfaces of an internal printed circuit board in an electrical connector; wherein there are four pairs of the differential pair wires for a same protocol signal transmission, and two pairs of said four pairs are intimately arranged side by side in said transverse direction while the remaining two pairs of said four pairs are intimately stacked with each other in the vertical direction at two levels.

19. The flat cable assembly as claimed in claim 9, wherein there are at least two pairs of the differential pair wires for another protocol signal transmission, and one pair of said at least two pairs and another pair of said at least two pairs are separated from each other by the remaining two pairs of said four pairs in said transverse direction.

* * * * *